US006302126B1

(12) United States Patent
Nava

(10) Patent No.: US 6,302,126 B1
(45) Date of Patent: Oct. 16, 2001

(54) ATTACHMENT FOR A WALKER

(76) Inventor: Victoriano Nava, 624 Darby, San Antonio, TX (US) 78207

( * ) Notice: Subject to any disclaimer, the term of this patent is extended or adjusted under 35 U.S.C. 154(b) by 0 days.

(21) Appl. No.: 09/515,509

(22) Filed: Feb. 29, 2000

(51) Int. Cl.[7] ..... A61H 3/00

(52) U.S. Cl. ..... 135/66; 135/67; 297/440.11; 297/6

(58) Field of Search ..... 297/440.11, 5, 297/6; 135/66, 67; 280/812

(56) References Cited

U.S. PATENT DOCUMENTS 2,473,090 * 6/1949 Becker .
2,713,890 * 7/1955 Mack .
4,456,284 * 6/1984 Saka ..... 280/812
4,553,786 * 11/1985 Lockett, III et al. ..... 297/440.11
4,974,620 * 12/1990 Quillan et al. ..... 135/67
5,012,963 * 5/1991 Rosenbaum ..... 135/67 X
5,280,800 * 1/1994 Pirrallo ..... 135/67
5,340,005 * 8/1994 Woods et al. ..... 135/66 X
5,496,094 * 3/1996 Schwartzkopf et al. .... 297/440.11 X
5,513,789 * 5/1996 Woods et al. ..... 135/67 X

* cited by examiner

*Primary Examiner*—Robert Canfield

(57) ABSTRACT

An attachment for a walker which may be used as a seat and has a convenient storage pouch. The attachment is formed from a single sheet of fabric having a pair of pockets formed at each of the opposing ends. A first one of the pockets conforms to the shape of the top ends of opposing horizontal support members of the walkers and is adapted to fit over the support members and function as the attachment means to the walker. The seat is formed by extending the fabric across the space between the horizontal support members and sliding the first pair of pockets downwardly over the top ends of the opposing horizontal support members until the support members are firmly embedded therein. The weight of the user is distributed over the entire seam eliminating relatively small stress points. A second one of the pockets functions solely as a storage means and has a zippered closure. An integral attachment means is provided for attaching the seat/storage pouch when the walker is in use.

3 Claims, 4 Drawing Sheets

ATTACHMENT FOR A WALKER

BACKGROUND OF THE INVENTION

The present invention relates to devices for the disabled. More particularly, it relates to an attachment for a walker which may be used as a seat and as a storage means.

STATEMENT OF THE PRIOR ART

Attachments for walkers are well known in the art and generally fall into two categories. The first category is the rigid, non-portable type. These attachments generally have clamps or other attachment means which enable a solid support member to be extended across and secured to the opposing handles of the walker. While these attachments are usually quite sturdy, they are not very portable as they add excessively to the overall weight of the walker and are difficult to stow in an out of the way position when the walker is to be used for walking.

The second category is the flexible, generally portable type. These attachments are generally made of cloth and employ various schemes for attachment to the walker. The devices are used essentially as makeshift seats and, given their relatively insubstantial structure, are dubious from a safety perspective. The entire weight of the user is typically supported by zippers or buttons or the like at some stress point and require the user to be certain the device is properly attached. The weight of the user will tend to dislodge the attachment from its proper position possibly causing the placement of stress in an area of the fabric not designed to be weight bearing, resulting in a potentially dangerous failure of the attachment.

U.S. Pat. No. 5,280,800 issued to Pirrallo discloses a removable one piece walker seat. The seat is comprised of a generally rectangular sheet of fabric having a pair of attachment bars affixed to both ends of the rectangular sheet. The sheet and the bars cooperate to form a seat when the sheet is suspended across opposing horizontal frame members of the walker. This assembly suffers from the drawback in that the bars add overall weight to the seat and walker. Also, the bars form stress points within the material which could cause failure of the seat with a high probability of injury to the user. By contrast, the present invention contemplates a seat for a walker having a single sheet of fabric with no metal bars or clamps. The seat has two pair of pockets, a first pair is sized and shaped for placement over the top end of the opposing horizontal frame members or handles of the walker, and a second pair having a zippered closure. The first pair of pockets form a weight bearing attachment means with a portion of the walker handle secure therein.

U.S. Pat. No. 4,974,620 issued to Quillan et al. discloses a seat for a walker comprised of a rectangular sheet of fabric. The sheet has a pair of loops formed therein which may be slid over the handrails to form attachments points for the seat. This arrangement suffers from several drawbacks. First, the loops are permanently stitched shut and thus the seat is very difficult to attach to the walker. Some disassembly of the walker is required in most cases and assembly is not easily accomplished by disabled persons. Also, the removably mountable embodiment discussed uses zippers to close the loops which are affixed to the handrails. In addition to the obvious difficulty of manipulating the zippers, the device would cause all of the weight of the user to be placed upon a zipper closure. By contrast, the present invention provides a seat for a walker which is easily attached to the walker and has very robust attachment points. No metal clamps or bars are used within or without the assembly.

U.S. Pat. No. 5,882,067 issued to Carbajal, et al. discloses a rigid foldable seat for a walker where the seat folds away when not in use. In addition to being heavy and bulky, these types of seats are also relatively expensive By contrast, the present invention concerns a seat formed of an inexpensive flexible single sheet. The seat can be safely and reliably attached to the walker and includes auxiliary attachment means which allow for attachment in a storage position.

U.S. Pat. No. 5,904,168 issued to Alulyan and U.S. Pat. No. 5,058,912 issued to Harroun both disclose modified walker devices which have built in seats. Unlike the present invention, these devices require users to purchase a new walker and discard what may be a perfectly new walker. For many disabled, the cost of such a device would be prohibitive. Also, parts for a non-standard device may be impossible to get eventually, further increasing the potential costs of ownership of such a device.

SUMMARY OF THE INVENTION

The present invention contemplates an attachment for a walker which may be used as a seat and has a convenient storage pouch. The attachment is formed from a single sheet of fabric having a pair of pockets formed at each of the opposing ends. A first one of the pockets conforms to the shape of the top ends of opposing vertical support members of the walkers and is adapted to fit over the support members and function as the attachment means to the walker. The seat is formed by extending the fabric across the space between the horizontal support members and sliding the first pair of pockets downwardly over the top ends of the opposing horizontal support members until the support members are firmly embedded therein. The weight of the user is distributed over the entire seam eliminating relatively small stress points. A second one of the pockets functions solely as a storage means and has a zippered closure.

Accordingly, it is a principal object of the invention to provide a new and improved attachment for a walker which functions as a temporary seat and storage pouch.

Accordingly, it is an object of the invention to provide an improved attachment for a walker which is portable and lightweight.

It is another object of the invention to provide an improved attachment for a walker which is flexible and yet strong enough to support the weight of an adult user.

It is another object of the invention to provide an improved attachment for a walker which can be attached to a standard walker without the use of clamps, rods, buttons, or other attachment means.

Finally, it is a general object of the invention to provide improved elements and arrangements thereof in an apparatus for the purposes described which is fully effective in accomplishing its intended purpose.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
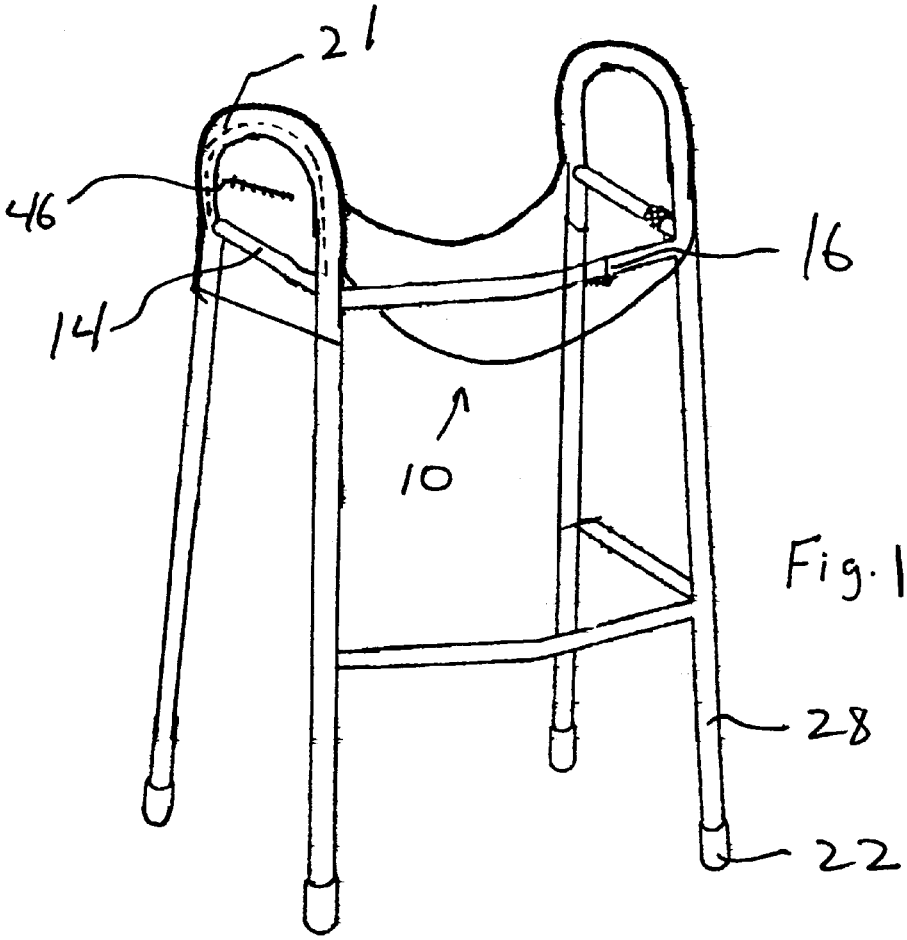
FIG. 1 shows a perspective view partly in section of the attachment of the present invention secured in position on a standard walker.

Referring now to FIGS. 1–5, the attachment of the present invention, generally indicated by the numeral 10, is shown. The attachment 10 may be made from a single piece of flexible material such as nylon or canvas and does not require any tools for connection or disconnection from a walker 12. The material is preferably machine washable and substantial enough to support an adult user. The attachment 10 has no connecting rods or clamps embedded therein or attached thereto and is thus very lightweight and portable. Also, the attachment 10 is easily manipulated by disabled and handicapped persons.

A standard walker 12 with which the attachment 10 may be used has a rigid frame comprised of two generally vertical support members 14 connected by at least one horizontal brace 16, which also serves to space apart the vertical support members 14 a sufficient distance for a user 18 to stand therebetween. The vertical support members 14 are arched and may be formed into a U-shape from a single steel tube 20. Alternatively, a portion of the arch 21 may be telescoping as will be explained in more detail later. Formed or attached at the ends of the tube 20 are feet 22 which are prefereably made of rubber or other durable material having good gripping characteristics. A pair of transverse support members 24 extends from one side of each of the vertical support members 14 and serve to strengthen the overall assembly.

The arch 21 extends above the horizontal brace 16 and the transverse support members 24 and serves as the attachment point for the attachment 10 of the present invention. It should be noted that many walkers 12 have an adjustable height mechanism which allows users of different heights to use the same walker. To that end, both of the arches 21 are formed from a separate U-shaped metal tube which has ends which are coaxial with the legs 28 of the walker 16. The arch 21, which includes the horizontal handles 30 may thus be slid relative to the legs 28 to provide a height adjustment for the handles 30. Coincidentally, this height adjustment feature also allows for adjustment of the seat height as will be explained in more detail later. As the attachment 10 is secured to the arch 21, the attachment 10 could not be used with walkers 12 not having this feature.

Figure 2A:
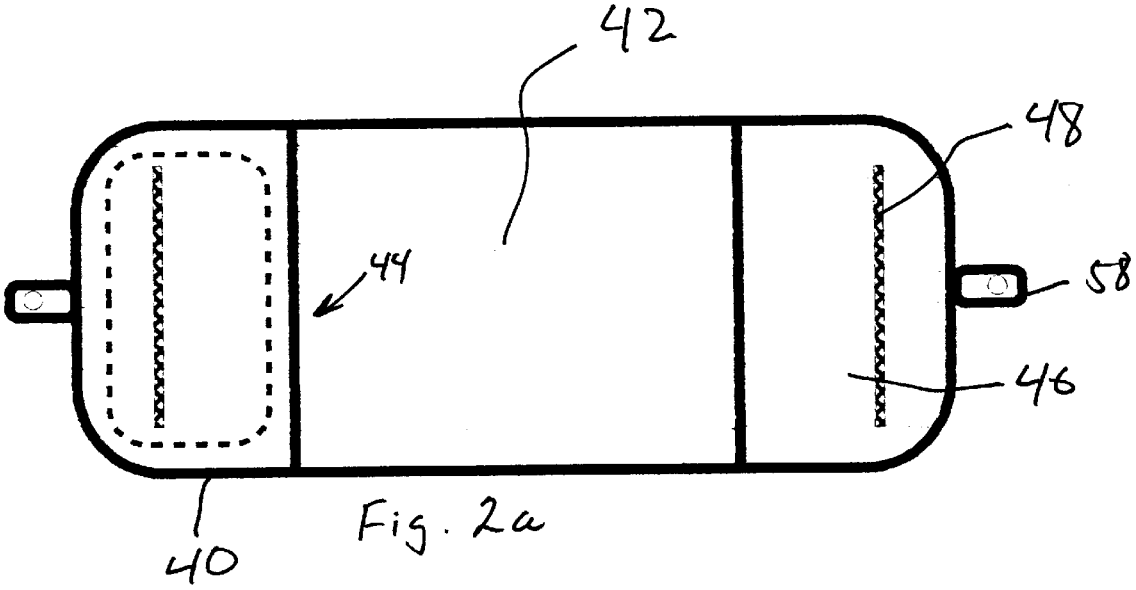
FIG. 2*a* shows a plan view, partly in section, of the attachment.

With particular reference to FIG. 2*a*, it can be seen that the attachment 10 is symmetrical having nearly identical opposing end sections 40 and a central seat portion 42 formed on a first side 43 of the material. As has been previously mentioned, this material is a heavy durable fabric such as canvas or nylon which can reliably support moe than 200 pounds. Each of the end sections 40 have a pair of pockets 44, 46 formed therein. Interior pockets 44 are sized to receive arches 21 while exterior pockets 46 are for convenient storage of small items such as billfolds, check books, etc. The user of the walker 12 can access these pockets 44, 46 when the attachment is either in the storage position or extended across the walker 12 in the seating position. Preferably, a zipper 48 is used as a closure means to prevent articles from falling out of the pockets 46 and for added security.

Figure 2B:
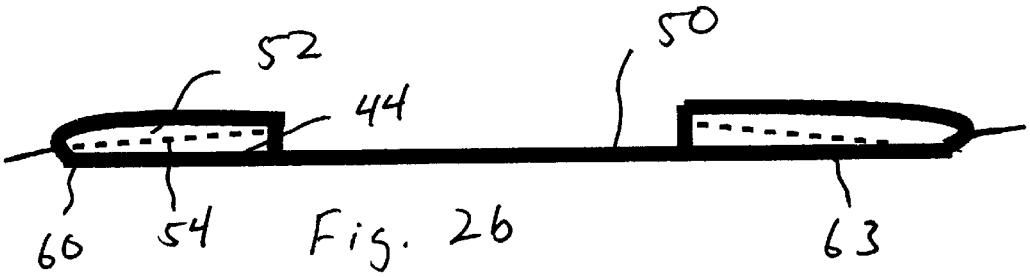
FIG. 2*b* shows a side view, partly in section, of the attachment.
Figure 4:
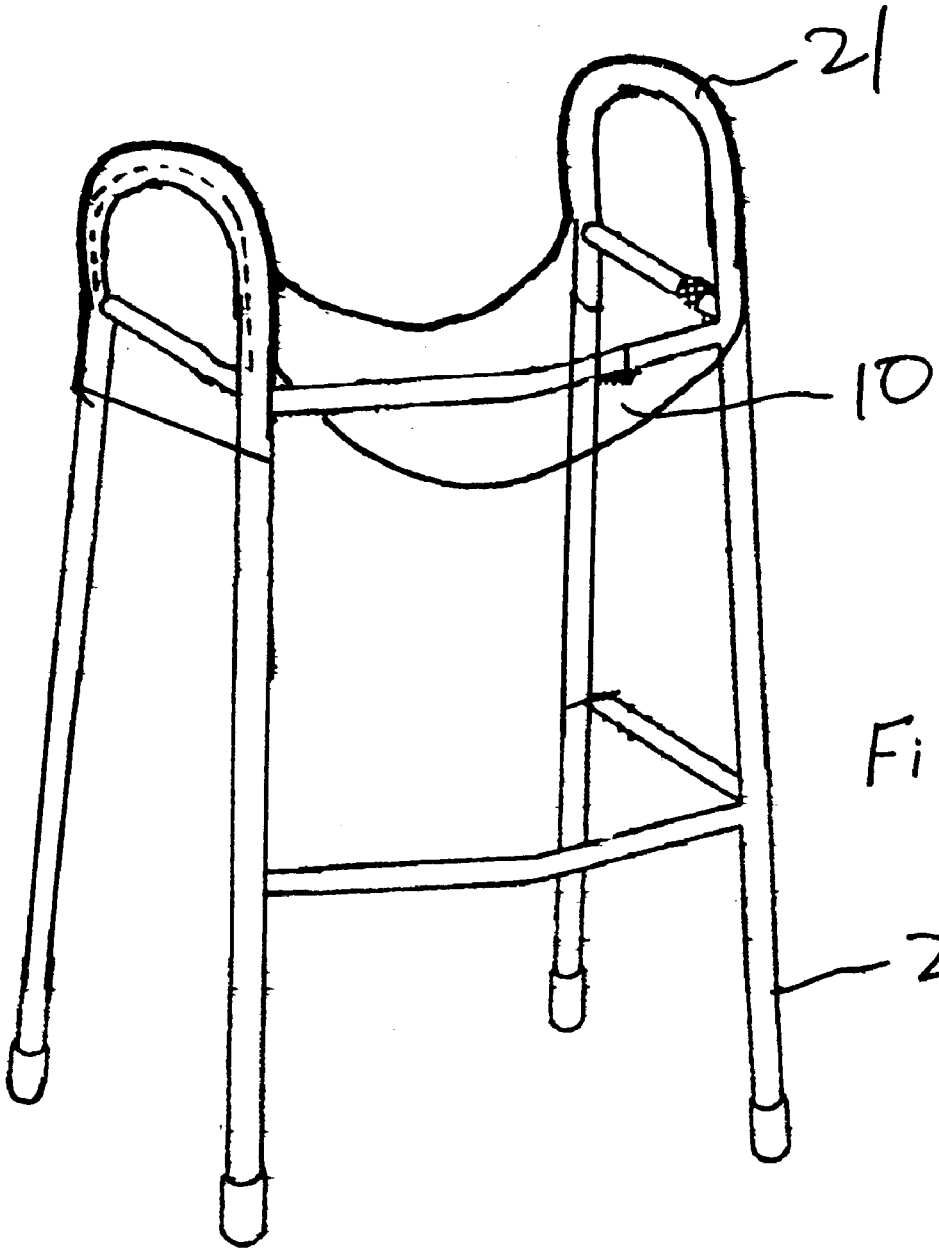
FIG. 4 shows a perspective view of a walker with the attachment secured in position whith a user seated thereon.
Figure 5:
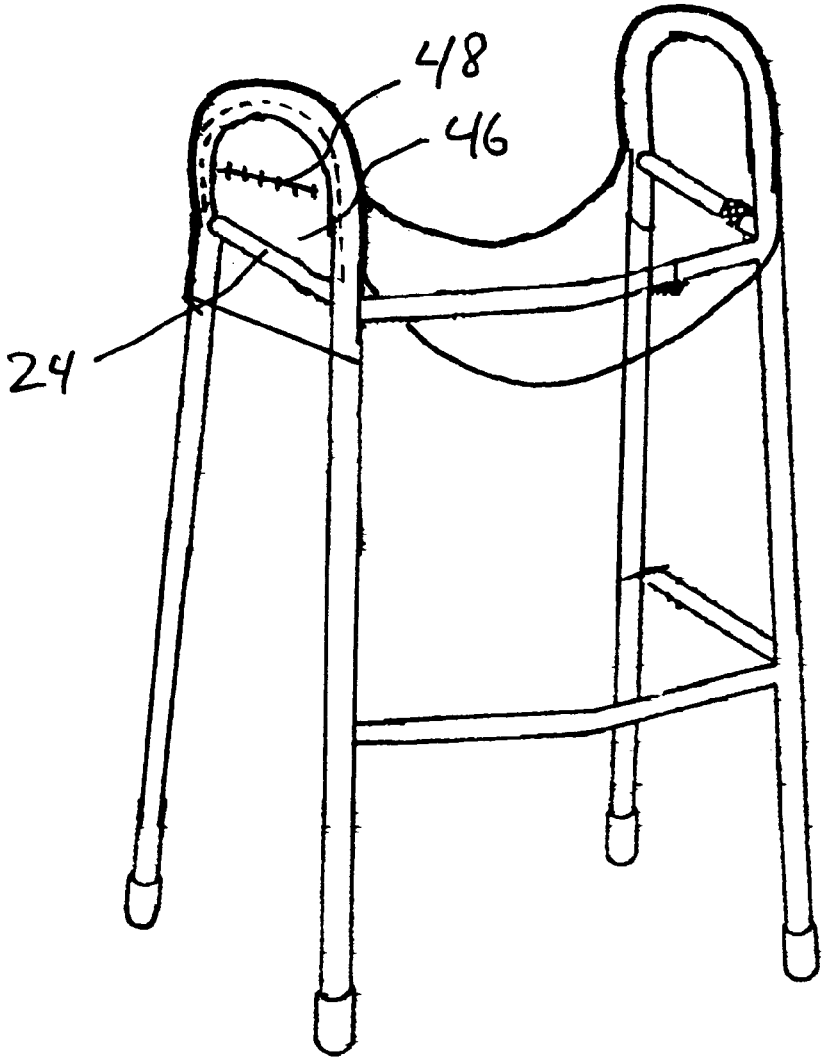
FIG. 5 shows a perspective view of the attachment secured onto a walker detailing one of the side pockets of the attachment.

Referring now to FIG. 2*b*, it can be seen that the seating portion 42 is formed on side 43 of the material while pockets 44, 46 are formed on the opposite side 50. Attached to the opposite side 50 is a section 52 formed from another piece of preferably similar material having zippered pocket 46 formed therein. Section 52 must be double or triple stitched to the opposite side 50 ensure that the attachment 10 does not fail during normal use. The interior side 54 of section 52 cooperates with the opposite side 50 to from pocket 44.

Figure 3:
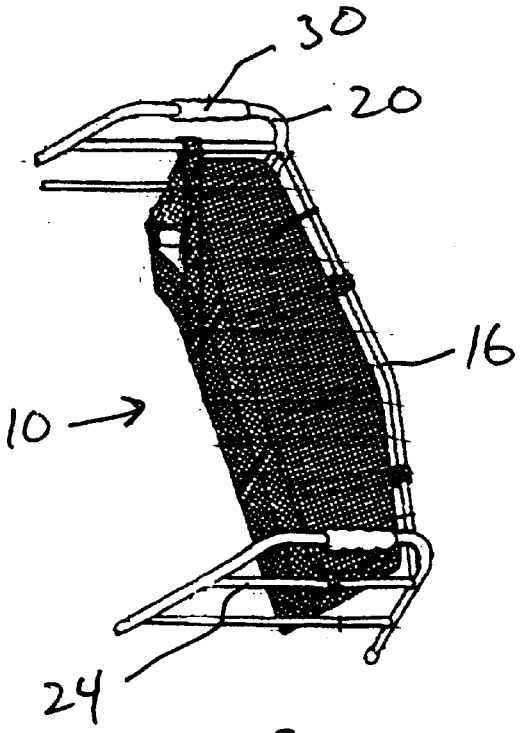
FIG. 3 shows a perspective view of a walker with the attachment in the storage position.

Referring now to FIG. 3, the attachment 10 is shown in the storage position. It can be seen that in this position the attachment 10 is easily accesible to the user, but disposed in anoninterfering manner to allow for unhampered usage of the walker 12. Tabs 58 formed on mutually opposing ends 60 of the attachment 10 have cooperating closure means attached thereto.

In operation, the attachment 10 is attached to the walker 12 by inserting the arches 21 on either side of the walker 12 into pocket 44. Full insertion of the arch 21 into the pocket 44 may be insured by pushing down on the seating portion 42. The user may then sit upon the seating portion. When it is desired to use the walker 12 for walking, the user simply pulls up on ends 60, initially grasping tabs 58 if necessary, until the attachment 10 is removed from the walker 12. The tabs 58 may then be secured about brace 16, with that attachment then allowed to hang therefrom as shown in FIG. 3.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. An invalid walker comprising:

opposing generally vertical side frame members connected by at least one horizontally extending brace;

a flexible seating member having generally rectangular upper and lower surfaces, said lower surface having a first pair of pockets formed thereon at opposing ends of said flexible member, said first pair of pockets shaped to allow insertion of opposing upper ends of said side frame members thereinto, each of said first pair of pockets having an outer panel, said outer panel having an inward facing surface and an outward facing surface;

a second pair of pockets formed in said outer panel;

said first and second pairs of pockets supported in a vertical position by said opposing generally vertical side frame members and said first pair of pockets disposed in a weight bearing relationship about said opposing upper ends of said side frame members;

wherein said seating member may be selectively moved to a storage position when said walker is in use.

2. The walker of claim 1 wherein said second pair of pockets includes a zippered closure.

3. The walker of claim 1 wherein said flexible main body is made of a denim material.

* * * * *